US011161732B2

(12) United States Patent
Cabiran

(10) Patent No.: US 11,161,732 B2
(45) Date of Patent: Nov. 2, 2021

(54) STIRRUP AND METHOD OF USING THE SAME

(71) Applicant: Michel Cabiran, Houston, TX (US)

(72) Inventor: Michel Cabiran, Houston, TX (US)

( * ) Notice: Subject to any disclaimer, the term of this patent is extended or adjusted under 35 U.S.C. 154(b) by 256 days.

(21) Appl. No.: 16/416,788

(22) Filed: May 20, 2019

(65) Prior Publication Data

US 2020/0369510 A1 Nov. 26, 2020

(51) Int. Cl.
*B68C 3/00* (2006.01)

(52) U.S. Cl.
CPC ..... *B68C 3/00* (2013.01); *B68C 2003/0025* (2013.01)

(58) Field of Classification Search
CPC ..... B68C 3/00; B68C 2003/0025
See application file for complete search history.

(56) References Cited

U.S. PATENT DOCUMENTS

| | | | |
|---|---|---|---|
| 1,062,327 | A | 5/1913 | Erbe |
| 1,079,801 | A | 11/1913 | Sarrett |
| 1,087,503 | A | 2/1914 | Dolan |
| 1,088,552 | A | 2/1914 | Douthitt |
| 1,186,651 | A | 6/1916 | Luttinger |
| 1,321,653 | A | 11/1919 | McKee |
| 1,480,314 | A | 1/1924 | Szymanski |
| 2,935,833 | A | 5/1960 | Woodhead |
| 4,587,798 | A | 5/1986 | Taylor |
| 4,761,938 | A | 8/1988 | Townsend |
| 5,661,957 | A | 9/1997 | Daly |
| 5,809,754 | A | 9/1998 | Schulte |
| 5,826,413 | A | 10/1998 | Bostock |
| 6,026,633 | A | 2/2000 | Burke, Jr. |
| 6,173,558 | B1 | 1/2001 | Burke, Jr. |
| 6,282,872 | B1 | 9/2001 | Schulte |
| 7,380,390 | B1 | 6/2008 | Brassfield |
| 7,543,427 | B2 | 6/2009 | Strauss |
| 7,574,849 | B2 | 8/2009 | Gottllieb |
| 8,752,671 | B1 | 6/2014 | Holman |
| 9,840,408 | B2 | 12/2017 | Ford |
| 2009/0266039 | A1 | 10/2009 | Gottlieb |
| 2014/0190135 | A1 | 7/2014 | Nettles |
| 2016/0194196 | A1 | 7/2016 | Ford |

FOREIGN PATENT DOCUMENTS

| | | |
|---|---|---|
| CN | 10-106509 | 4/2011 |
| EP | 2016021 | 2/2012 |
| FR | 2258772 | 8/1975 |
| FR | 2775681 | 6/1998 |
| GB | 2037139 | 7/1980 |
| GB | 2359476 | 6/2001 |
| WO | WO2017177078 | 10/2017 |

*Primary Examiner* — Jessica B Wong
(74) *Attorney, Agent, or Firm* — Ira Domnitz; Kelly Stephens; Matthew Juren

(57) ABSTRACT

A system and method for use of a stirrup with multiple treads and side pieces.

12 Claims, 8 Drawing Sheets

STIRRUP AND METHOD OF USING THE SAME

CROSS-REFERENCE TO RELATED APPLICATIONS

Not applicable.

STATEMENT REGARDING FEDERALLY SPONSORED RESEARCH

Not applicable.

BACKGROUND

The present invention generally relates to an improved stirrup for use in riding and a method of using the same.

The present invention is distinguished from U.S. Pat. No. 261,733 as U.S. Pat. No. 261,733 discloses a stop for the toe of the boot, preventing it from going through the stirrup and becoming caught around the ankle. This particular stop differs in that it is a thin wire type design that does not pivot. It does not provide a second step like the current invention.

The present invention is distinguished from U.S. Pat. No. 592,587 as U.S. Pat. No. 592,587 discloses a spring-loaded stirrup which extends to a lower position when the rider is mounting, but locks in place once the rider is in riding position on the horse. The current invention has no extendable spring parts.

The present invention is distinguished from U.S. Pat. No. 706,468 as U.S. Pat. No. 706,468 is a stirrup strap, not a stirrup, and is used to allow the stirrup to swivel on the end of the strap. The current invention does not provide a swivel, just a second or third step to assist in mounting the horse.

The present invention is distinguished from U.S. Pat. No. 717,850 as U.S. Pat. No. 717,850 is a retractable two step stirrup. This stirrup is meant to be used with the second step retracted once the rider is mounted on the horse. This differs from the current invention in that the current invention's second step is not retractable.

The present invention is distinguished from U.S. Pat. No. 877,062 in that U.S. Pat. No. 877,062 is a stirrup that opens up from the side when a certain force is put on the side of the stirrup. The purpose of this mechanism is to release the foot if the foot in the stirrup is pulled forcefully to the side as would happen if the rider falls off the horse. This differs from the current invention in that the present invention does not have a release mechanism.

The present invention is distinguished from U.S. Pat. No. 932,886 in that U.S. Pat. No. 932,886 is a stirrup that opens up from the side when a certain force is put on the side of the stirrup. The purpose of this mechanism is to release the foot if the foot in the stirrup is pulled forcefully to the side as would happen if the rider falls off the horse. This differs from the current invention in that the current invention does not have a release mechanism.

The present invention is distinguished from U.S. Pat. No. 1,062,327 in that the invention of U.S. Pat. No. 1,062,327 is a stirrup that pushes away from the shoe or boot with a spring allowing the stirrup to clear the shoe or boot when the shoe or boot is removed from the stirrup. This differs from the current invention in that the current invention does not have a push away mechanism.

The present invention is distinguished from U.S. Pat. No. 1,079,801 in that U.S. Pat. No. 1,079,801 discloses a stirrup with a mechanism to release the bottom of the stirrup, releasing the shoe or boot of a rider. This differs from the current invention in that the present invention does not have a release mechanism.

The present invention is distinguished from U.S. Pat. No. 1,087,503 in that U.S. Pat. No. 1,087,503 discloses a stirrup with a mechanism to release the bottom of the stirrup, releasing the shoe or boot of a rider. This differs from the current invention in that the present invention does not have a release mechanism.

The present invention is distinguished from U.S. Pat. No. 1,088,552 in that U.S. Pat. No. 1,088,552 discloses a stirrup with a mechanism to release the side of the stirrup, releasing the shoe or boot of a rider. This differs from the current invention in that the present invention does not have a release mechanism.

The present invention is distinguished from U.S. Pat. No. 1,186,651 in that U.S. Pat. No. 1,186,651 discloses a stirrup with a mechanism to release the side of the stirrup, releasing the shoe or boot of a rider. This differs from the current invention in that the current invention does not have a release mechanism.

The present invention is distinguished from U.S. Pat. No. 1,321,653 in that U.S. Pat. No. 1,321,653 discloses a stirrup with a mechanism to break away the stirrup, releasing the shoe or boot of a rider when the boot or shoe is rotated or twisted in the stirrup. This differs from the current invention in that the current invention does not have a release mechanism.

The present invention is distinguished from U.S. Pat. No. 1,480,314 in that U.S. Pat. No. 1,480,314 discloses a stirrup with a toothed latch which is held in place by the pressure of the boot on the bottom inside of the stirrup. When a rider falls or is thrown, the pressure from the boot is relieved and the toothed notch can be separated with a side pressure from the boot which opens the stirrup side so the boot can be released from the stirrup. This differs from the current invention in that the current invention does not have a release mechanism.

The present invention is distinguished from U.S. Pat. No. 2,935,833 in that U.S. Pat. No. 2,935,833 discloses a stirrup retracting device or strap which lowers a stirrup to a mounting position, then retracts it to a riding position when a switch is activated by the top of the boot. This differs from the current invention in that the current invention is a double stirrup, and the lower mounting position of the stirrup does not retract, and the riding position is the second stirrup above the bottom stirrup or the bottom stirrup depending on the height of the rider.

The present invention is distinguished from U.S. Pat. No. 4,587,798 in that U.S. Pat. No. 4,587,798 discloses a mechanism that will release a boot when boot force is no longer applied to the bottom of the stirrup but instead applied to the side of the stirrup, as for instance when a rider falls off or is thrown from a horse. This differs from the current invention in that the current invention does not have a boot release mechanism.

The present invention is distinguished from U.S. Pat. No. 4,761,938 in that U.S. Pat. No. 476,938 discloses a secondary stirrup which hangs lower than the riding stirrup when placed on the riding stirrup. It appears that it can be hung and removed easily by a person who is standing on the ground next to the horse, but with difficulty by a person who is in the saddle. It is loosely attached to the riding stirrup, and if left there while riding it would probably fall off. This differs from the current invention in that the current invention's mounting stirrup is firmly attached to the riding stirrup.

The present invention is distinguished from U.S. Pat. No. 5,661,957 in that U.S. Pat. No. 5,661,957 discloses a stirrup which allows extension by means of a spring and notched rod from a mechanism where the stirrup attaches to the saddle. The extendable stirrup adjusts for mounting and riding by people of different heights. This differs from the current invention in that the current invention does not extend or retract, and the mounting and riding positions are from two different height stirrups.

The present invention is distinguished from U.S. Pat. No. 5,809,754 in that U.S. Pat. No. 5,809,754 discloses a stirrup that provides a second lower step which is spring loaded, and which pivots up and out of the way when not in use. The second lower step helps shorter people mount a horse. This differs from the current invention in that the current invention has a second lower step that does not pivot and is permanent which is used to help people mount a horse.

The present invention is distinguished from U.S. Pat. No. 5,826,413 in that U.S. Pat. No. 5,826,413 discloses a release mechanism for a rider's boot, shoe or foot if it were caught in the stirrup while falling off the horse or being thrown from it. The current invention does not provide for a release mechanism for a boot, shoe, or foot.

The present invention is distinguished from U.S. Pat. No. 6,026,633 in that U.S. Pat. No. 6,026,633 discloses a retractable second lower step to allow someone to step into in order to make it easier to mount the horse. This differs from the current invention in that the current invention does not have a retracting mechanism.

The present invention is distinguished from U.S. Pat. No. 6,173,558 in that U.S. Pat. No. 6,173,558 discloses a retractable second lower step to allow someone to step into in order to make it easier to mount the horse. This differs from the current invention in that the current invention does not have a retracting mechanism.

The present invention is distinguished from U.S. Pat. No. 6,282,872 in that U.S. Pat. No. 6,282,872 discloses a stirrup that pivots out to provide a second step, and in case of a fall will pivot out to release the boot, shoe, or foot of the person riding the horse with his boots in the stirrup. This differs from the current invention in that the current invention does not have a pivoting step or release mechanism.

The present invention is distinguished from U.S. Pat. No. 7,380,390 in that U.S. Pat. No. 7,380,390 discloses a retractable second lower step. This differs from the current invention in that the current invention does not have a retractable step.

The present invention is distinguished from U.S. Pat. No. 16,032 as U.S. Pat. No. 16,032 is a half-cup shaped device designed to prevent a foot, shoe, or boot from slipping through the stirrup and by adding a pivot allowing the foot to be extracted more easily. This differs from the current invention in that the current invention is designed to supply a permanent second lower stirrup step to assist a person mounting a horse.

The present invention is distinguished from U.S. Pat. No. 7,543,427, Jun. 9, 2009. Stirrup as that invention relates a flexible stirrup. This differs from the current invention in that the current invention is not flexible but is a double stirrup.

The present invention is distinguished from U.S. Pat. No. 70,053 as U.S. Pat. No. 70,053 prevents the boot from slipping through the stirrup and by pivoting the stirrup allowing for quick release of the boot from the rear of the stirrup but does not provide a second step like the current invention.

The present invention is distinguished from U.S. Pat. Nos. 7,574,849 as 7,574,849 discloses a pivoting second step and a cage to prevent a rider's boot, shoe, or foot from being entangled in the stirrup when falling off or being thrown from a horse. This differs from the current invention in that the current invention does not have a pivoting step.

The present invention is distinguished from U.S. Pat. Nos. 9,840,408 as 9,840,408 discloses a second step that is retractable which extends below the first stirrup step. This differs from the current invention in that the current invention does not have a retractable step.

The present invention is distinguished from FR2258772 as FR2258772 discloses a retractable foot bar which can be lowered for a rider to put his foot, shoe or boot on to assist in mounting a horse. This differs from the current invention in that the current invention does not have a retractable foot bar.

The present invention is distinguished from GB2037139 as 2037139 discloses a stirrup strap which can be adjusted in length. This differs from the current invention in that the current invention is a double stirrup.

The present invention is distinguished from EP2016021B1 as 2016021 discloses an adjustable platform where the stirrup should be. This differs from the current invention in that the current invention is not an adjustable platform; it is a double stirrup.

The present invention is distinguished from FR2775681A1 as FR2775681 discloses a stirrup attached to an adjustable strap which allows it to be adjusted up and down. This differs from the current invention in that the current invention is a double stirrup.

The present invention is distinguished from GB2359476 as 2359476 discloses a flat rigid step with a single cord extending from one side of the step to the other, where the cord is fastened to a stirrup by looping around the strap or around the stirrup to form a lower step to assist in mounting a horse. This differs from the current invention in that the current invention does not have any cords or other flexible members in it.

The present invention is distinguished from KR101026509B1 as 101026509 discloses a releasable stirrup. This differs from the current invention in that the current invention is not a releasable stirrup.

The present invention is distinguished from US20090266039A1 as 20090266039 discloses a side releasable stirrup. This differs from the current invention in that the current invention is not releasable.

The present invention is distinguished from US20140190135A1 as 20140190135 discloses a stirrup whose angle can be varied while riding due to a pivot at the point of attachment of the stirrup to the stirrup strap. This differs from the current invention in that the current invention is not pivoted at the point of attachment to the stirrup strap.

The present invention is distinguished from US20160194196A1 as 20160194196 discloses a second step that is retractable which extends below the first stirrup step. This differs from the current invention in that the current invention does not have a retractable step.

The present invention is distinguished from WO2017177078A1 as 2017177078 discloses a system that prevents a boot, shoe, or foot from being caught in the stirrup, and allows the stirrup height to be adjusted quickly and easily. This differs from the current invention in that the current invention does not have a height adjustment other than the standard stirrup strap.

SUMMARY

In some embodiments of the present invention, the present invention is a system and method for use of a stirrup with multiple treads and side pieces. In several embodiments, the present invention can use multiple standing straps or rungs.

In several embodiments, the present invention is an improved stirrup comprising: a first open-ended rung; said first rung further comprising; an open-ended top portion with an orifice on each open-ended rung side and a solid bottom rung portion with two orifices running through the bottom portion; a second open ended rung; said second rung further comprising; an open ended second top portion with an orifice on each open-ended rung side, two orifices on the upward faces of each open-ended rung side, and a solid second bottom rung portion; a hollow or internally threaded bar; a first set of screws; a second set of screws; a screw fastening bar set; wherein said hollow or internally threaded bar is mechanically attached between said open-ended top portion of said first open-ended rung by said first set of screws being inserted through said open ended top portion orifice and inserted or threaded into said hollow or internally threaded bar; and wherein said screw fastening bar set is inserted into said orifices on said open-ended rung sides of second rung, and said second rung is mechanically attached to said first rung by having said second set of screws inserted through said two orifices on said bottom rung portion of said first rung and into said two orifices on the upward faces of each open-ended rung side of said second rung and threaded into or fastened to said screw fastening bar sets. In several embodiments, said first rung and said hollow or threaded bar are precast as one piece. In several embodiments there is a tapadero; said tapadero further comprising; a front barrier attached to a first shelf and a second shelf, and said first rung bottom is attached to the said first shelf and said second rung bottom is attached to said second shelf. In several embodiments, said tapadero is comprised of one piece of material.

In several embodiments, the invention is an improved stirrup comprising: a first open-ended rung; said first rung further comprising; an open-ended top portion with an orifice on each open-ended rung side and a solid bottom rung portion with two orifices running through the bottom portion; a second open-ended rung; said second rung further comprising; an open-ended second top portion with an orifice on each open-ended rung side, two orifices on the upward faces of each open-ended rung side, and a solid second bottom rung portion with two orifices running through the bottom portion; a third open-ended rung; said third rung further comprising; an open-ended third top portion with an orifice on each open-ended rung side, two orifices on the upward faces of each open-ended rung side, and a solid third bottom rung portion; a hollow or internally threaded bar; a first set of screws; a second set of screws; a third set of screws; a screw fastening bar set; a second screw fastening bar set; wherein said hollow or internally threaded bar is mechanically attached between said open-ended top portion of said first open-ended rung by said first set of screws being inserted through said open-ended top portion orifice and inserted or threaded into said hollow or threaded bar; wherein said screw fastening bar set is inserted into said orifices on said open-ended rung sides of second rung, and said second rung is mechanically attached to said first rung by having said second set of screws inserted into said two orifices on said bottom rung portion of said first rung and into said two orifices on the upward faces of each open-ended rung side of said second rung then threaded into or fastened to screw fastening bar set; and wherein said second screw fastening bar set is inserted into said orifices on said open-ended rung sides of third rung, and said third rung is mechanically attached to said second rung by having said third set of screws inserted into said orifices on said bottom rung portion of said second rung and into said two orifices on the upward faces of each open-ended rung side of said third rung then threaded into or fastened to screw fastening bar set. In several embodiments, said first rung and said hollow or threaded bar are precast as one piece. In several embodiments, the invention consists of a tapadero; said tapadero further comprising; a front barrier attached to a first shelf, a second shelf, and a third shelf; and said first rung bottom is attached to the said first shelf, said second rung bottom is attached to the said second shelf; and said third rung bottom is attached to the said third shelf. In several embodiments, said tapadero is comprised of one piece of material.

In several embodiments the present invention is a multitude of open-ended rungs; each individual rung of said multitude of rungs further comprising; an open-ended top portion with an orifice on each open-ended rung side and a solid bottom rung portion with two orifices running through the bottom portion; one hollow or internally threaded bar; a multitude of sets of screws; a multitude of screw fastening bar sets; wherein one individual member of said hollow or internally threaded bar is mechanically attached between one individual member of said open-ended top portion of said one individual member of said open-ended rung by at least one individual member of said set of screws being threaded or inserted through said open-ended top portion orifice through and into said one individual member of hollow or threaded bar; wherein at least one second member of said screw fastening bar sets is inserted into said orifice on said open-ended rung sides of a second said rung, and said second rung is mechanically attached to said first rung by having said second set of screws inserted through said two orifices on said bottom rung portion of said first rung and into said two orifices on the upward faces of each open-ended rung side of said second rung in a potential series of rung attachments and threaded into or fastened to said screw fastening bar sets. In several embodiments, said multitude of rung and said one hollow or threaded bar are precast as a multitude of one single piece. In several embodiments, there is a tapadero; said tapadero further comprising; a front barrier attached to a first shelf, a second shelf and a third shelf; and said first rung bottom is attached to the said first shelf, said second rung bottom is attached to the said second shelf, and said third rung bottom is attached to the said third shelf. In several embodiments, said tapadero is comprised of one piece of material.

In several embodiments of the present invention, one method of getting into the stirrups is as follows: If the upper stirrups are adjusted for the user's height and the user is getting up on the left side of the horse: 1) The user puts his left foot in the lower left stirrup and lifts himself up onto the saddle using his left leg and two hands while putting his right leg on the other side of saddle 2) Once in the saddle the user moves his left foot from the lower left stirrup and puts it into the upper left stirrup, and 3) The user pushes with the left leg and slides to the right till he is centered in the saddle then the user puts his right foot into the upper right stirrup.

In several embodiments, a second method of getting into the stirrups is as follows: if the upper stirrups are adjusted for the user's height and the user is getting up on the left side of the horse: 1) The user puts her right foot into the lower left stirrup and lifts herself up with her right foot and two hands on the saddle, 2) The user puts her left foot into the upper left stirrup then removes her right foot from the lower left stirrup and swings her right leg over the saddle so that she is sitting centered in the saddle, and then 3) The user puts her right foot into the upper right stirrup. Similar methods can be used when mounting on the right side of the horse.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1:
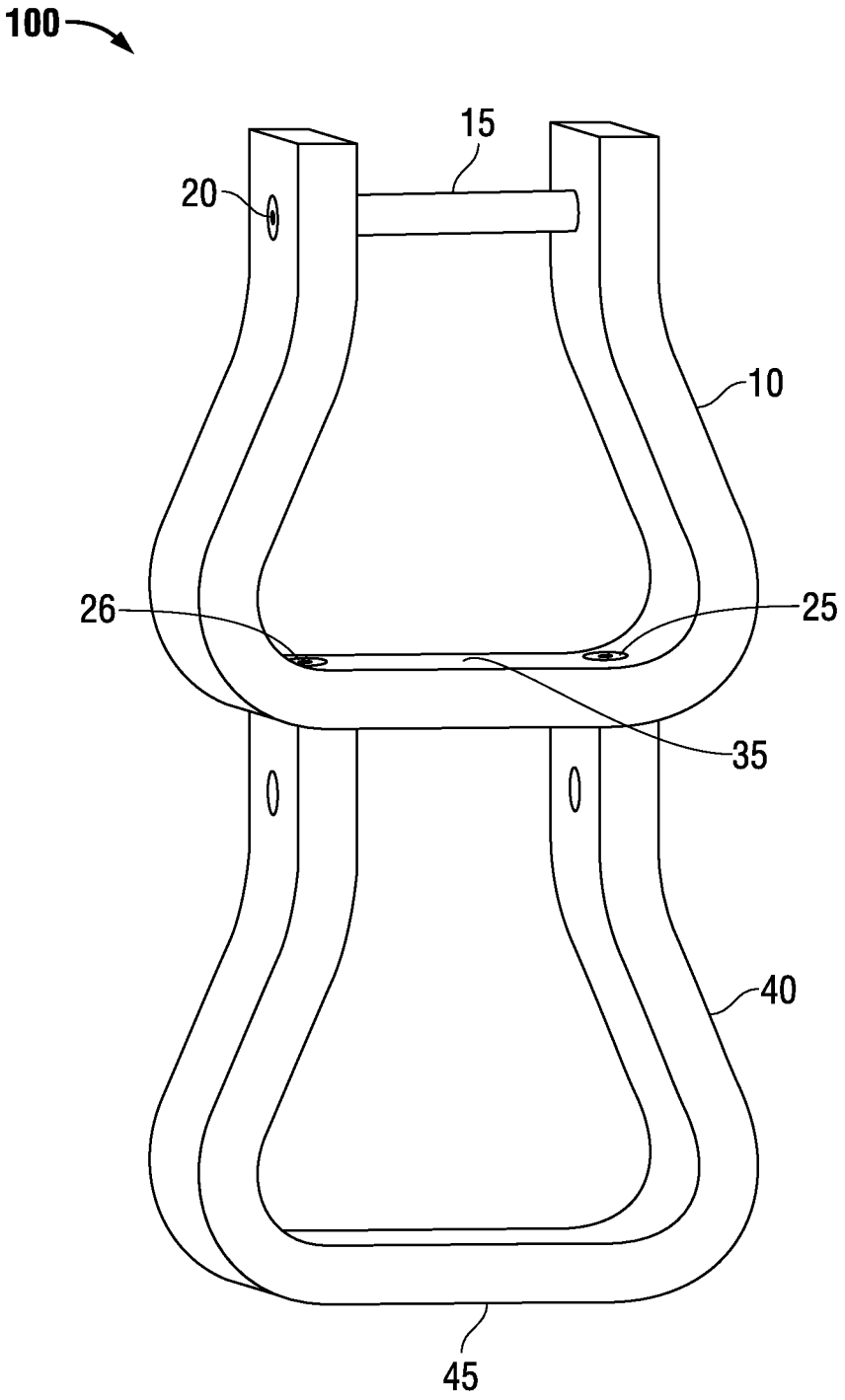
FIG. 1 is one embodiment of the invention in assembled perspective view with two stirrups.

One or more illustrative embodiments incorporating the invention disclosed herein are presented below. Applicant has created a revolutionary multi-rung stirrup.

In the following description, certain details are set forth such as specific quantities, sizes, etc. to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary 2016. Definitions and/or interpretations should not be incorporated from other patent applications, patents, or publications, related or not, unless specifically stated in this specification or if the incorporation is necessary for maintaining validity. As utilized herein, the following terms have the following definitions. "Screw" can be defined herein as "any object capable of attaching one object to another, and can include, but is not limited to, standard screws, nails, threaded bolts, dowels, and the like." "Dowel nut" can be defined herein as "a cylinder, typically metal, drilled and threaded perpendicularly to its cylindrical axis, made to receive a threaded fastener, typically a threaded metal screw, so that when the screw is tightened it draws the threaded cylinder and anything the cylinder is inserted into toward the head of the screw and anything the screw head is butted up against, typically used in pulling wooden furniture joints and other non-metal joints together tightly which would not normally be able to sustain the stresses of tight metal screw threads. The threaded metal cylinder functions as a nut except while the nut can be tightened along its axis against a typically flat surface, a threaded cylinder can be slid into a hole and the hole and whatever the hole is in can be drawn and tightened at right angles to the axis of the cylinder." "Screw Fastening Cylinder" can be defined herein as "a cylinder, typically metal, drilled and threaded perpendicularly to its axis, made to receive a threaded fastener, typically a threaded metal screw, so that when the screw is tightened it draws the threaded cylinder and anything the cylinder is inserted into toward the head of the screw and anything the screw head is butted up against, typically used in pulling wooden furniture and other non-metal joints together tightly which would not normally be able to sustain the stresses of tight metal screw threads. The threaded cylinder functions as a nut except while the nut can be tightened along its axis against a typically flat surface, a threaded cylinder can be slid into a hole and the hole and whatever the hole is in can be drawn and tightened at right angles to the axis of the cylinder." "Nails" can be interpreted as standard nails driven into wood or nails with ends flattened and used as rivets or nails with raised metal surface(s) along its cylindrical length which are driven into a metal orifice of size slightly smaller than the diameter of the raised surfaces on the nail in which case the nail would be fastened into the metal orifice. "Rivets" can be interpreted as a steel cylinder with a substantially constant diameter with one end having a larger diameter. When the rivet is inserted into a hole in two or more parts to hold two or more parts together the opposite head is expanded through pressure and/or heat to lock the rivet in the holes and hold the parts together. "Screw Fastening Bar" can be defined herein "as a cylinder or non-cylindrical bar held in a first part used to fasten a screw, nail, rivet, or other fastener held in a second part, and hold said first part together with a second part." Some types of screw fastening bars could be a dowel nut or a screw fastening cylinder. "Tapadero" can be defined herein "as a cover for a stirrup or stirrups, typically made of leather, used to protect the foot, shoe, or boot from brush when riding, to prevent brush and sticks from getting caught in the stirrup when riding, and to prevent the foot, shoe, or boot from slipping through the stirrup and getting caught in the stirrup." "Rungs or stirrups", as used herein, can be made with one or more modified circular or rectangular rings fastened together in addition to modified U-shaped rungs.

Certain terms are used in the following description and claims to refer to system components. As one skilled in the art will appreciate, different persons may refer to a component by different names. This document does not intend to distinguish between components that differ in name, but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 is one embodiment of the invention in assembled perspective view with two stirrups. A stirrup apparatus 100 may be constructed with two modified U-shaped rungs 10 and 40. In several embodiments, rungs 10 and 40 may be comprised of aluminum, metal, hardened plastic, or other materials capable of supporting the weight of an adult human when a foot, boot, or shoe is placed upon either rung 10 or 40. In several embodiments, rungs 10 and 40 can be designed to have flat interior or exterior faces. In several embodiments, rungs 10 and 40 can be designed to have rounded or other three-dimensional shaped interior or exterior faces. In several embodiments, rungs 10 and 40 can be identical in manufacture such that rungs 10 and 40 could be interchanged or replaced if the rung is damaged or needs replacement. In some embodiments, the stirrup apparatus 100, or parts of it, can be composed of bent laminated plywood sandwiched between two pieces of thin bent sheets of metal for strength. In some embodiments, rungs 10 and 40 can have variant three-dimensional geometric shapes capable of having a foot, boot, or shoe pass through.

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via a screw or nail 20 as is known in the art by the screw or nail 20 passing through an orifice through the upper open portion of rung 10. In several embodiments, bar 15 can be hollow or internally threaded and supported by a screw or having bar 15 go through the sides of the U-shaped part for more support with washers and screws on either side.

In several embodiments, rung 10 can be attached to lower rung 40 via screws or nails 26 and 25 which can pass through orifices on the lower portion 35 of rung 10 in a manner known in the art. Further shown is lower portion 45 on lower rung 40. In several embodiments, rungs 10 and 40 can be identical, of variant shape, or composed of variant materials. In several embodiments, rung 10 can be attached to lower rung 40 via bonding, being pre-cast, soldered, brazed or welded. In several embodiments, rungs 10 and 40 can be identical, of variant shape, or composed of variant materials.

Figure 2:
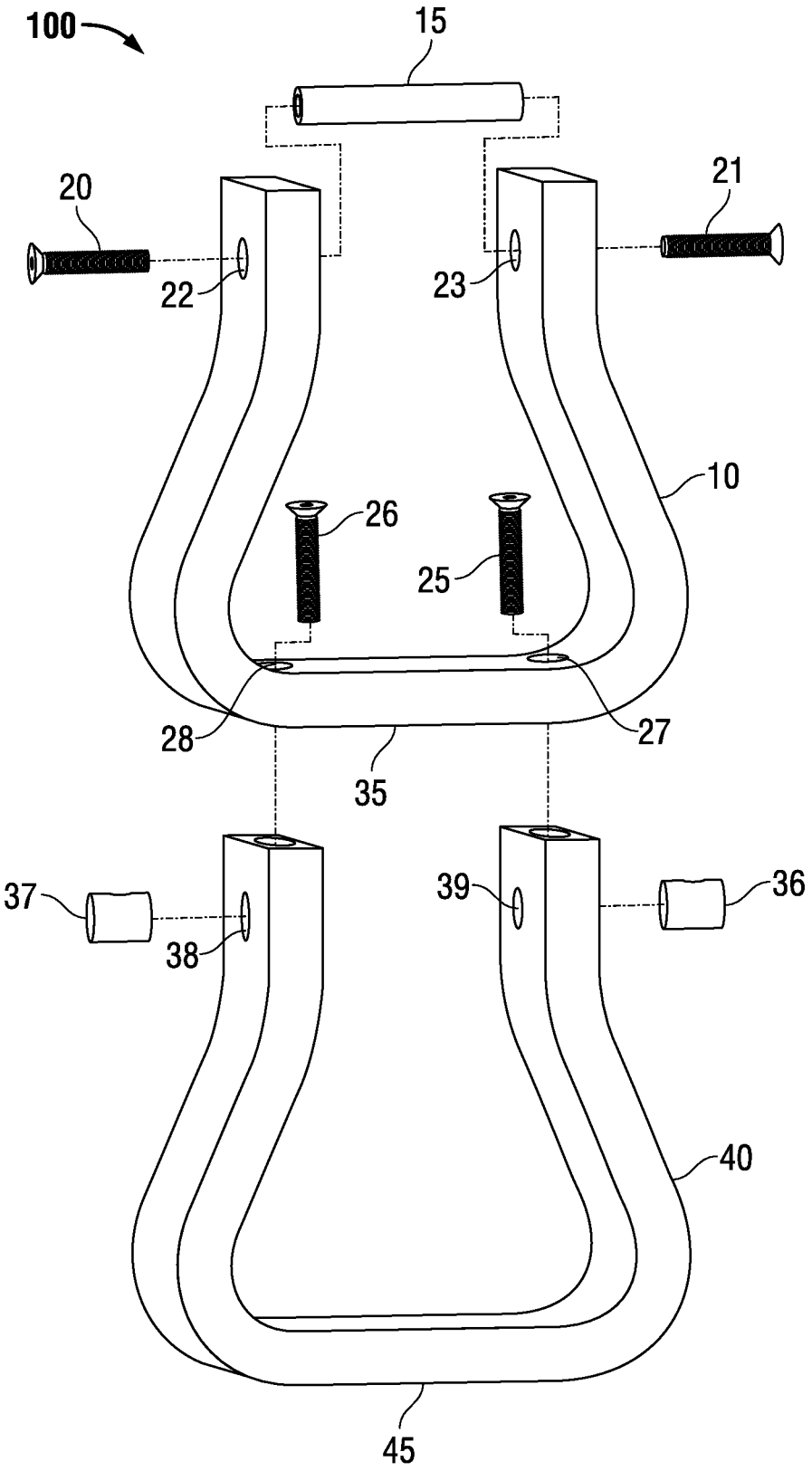
FIG. 2 is one embodiment of the invention in exploded perspective view with two stirrups.

FIG. 2 is one embodiment of the invention in exploded perspective view with two stirrups. As shown, stirrup apparatus 100 may be constructed with two modified U-shaped rungs 10 and 40. In several embodiments, rungs 10 and 40 may be comprised of aluminum, metal, hard plastic, or other materials capable of supporting the weight of a human when a foot, boot or shoe is placed upon either rung 10 or 40. In several embodiments, rungs 10 and 40 can be designed to have flat interior or exterior faces. In several embodiments, rungs 10 and 40 can be designed to have rounded or other three-dimensional shape interior or exterior faces. In several embodiments, rungs 10 and 40 can be identical in manufacture such that rungs 10 and 40 could be interchanged or replaced if the rung is damaged or needs replacement.

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via screws or nails 20 and 21 as is known in the art by the screw or nails 20 and 21 passing through an orifice through the upper open portion of rung 10. As further illustrated, screws or nails 20 and 21 can pass through orifices 22 and 23 respectively. In several embodiments, bar 15 can be hollow or internally threaded and supported by a through screw or having bar 15 go through the sides of the U-shaped part for more support with washers and screws on either side.

In several embodiments, rung 10 can be attached to lower rung 40 via screws or nails 25 and 26 which can pass through orifices 27 and 28 on lower portion 35 of rung 10 in a manner known in the art. Further shown are dowel nuts 37 and 36 which can be inserted into orifices 38 and 39, respectively, in order to secure screws or nails 26 and 25, respectively, as is known in the art. Further shown is lower portion 45 on lower rung 40. Some types of screw fastening bars could be dowel nuts or a screw fastening cylinders and may be referenced in claims as a "Screw Fastening Bar Set." "Screw Fastening Bar Set" can be also defined herein "as a cylinder or bar held in a first part used to fasten a screw, nail, rivet, or other fastener held in a second part, and hold said first part together with a second part."

Figure 3:
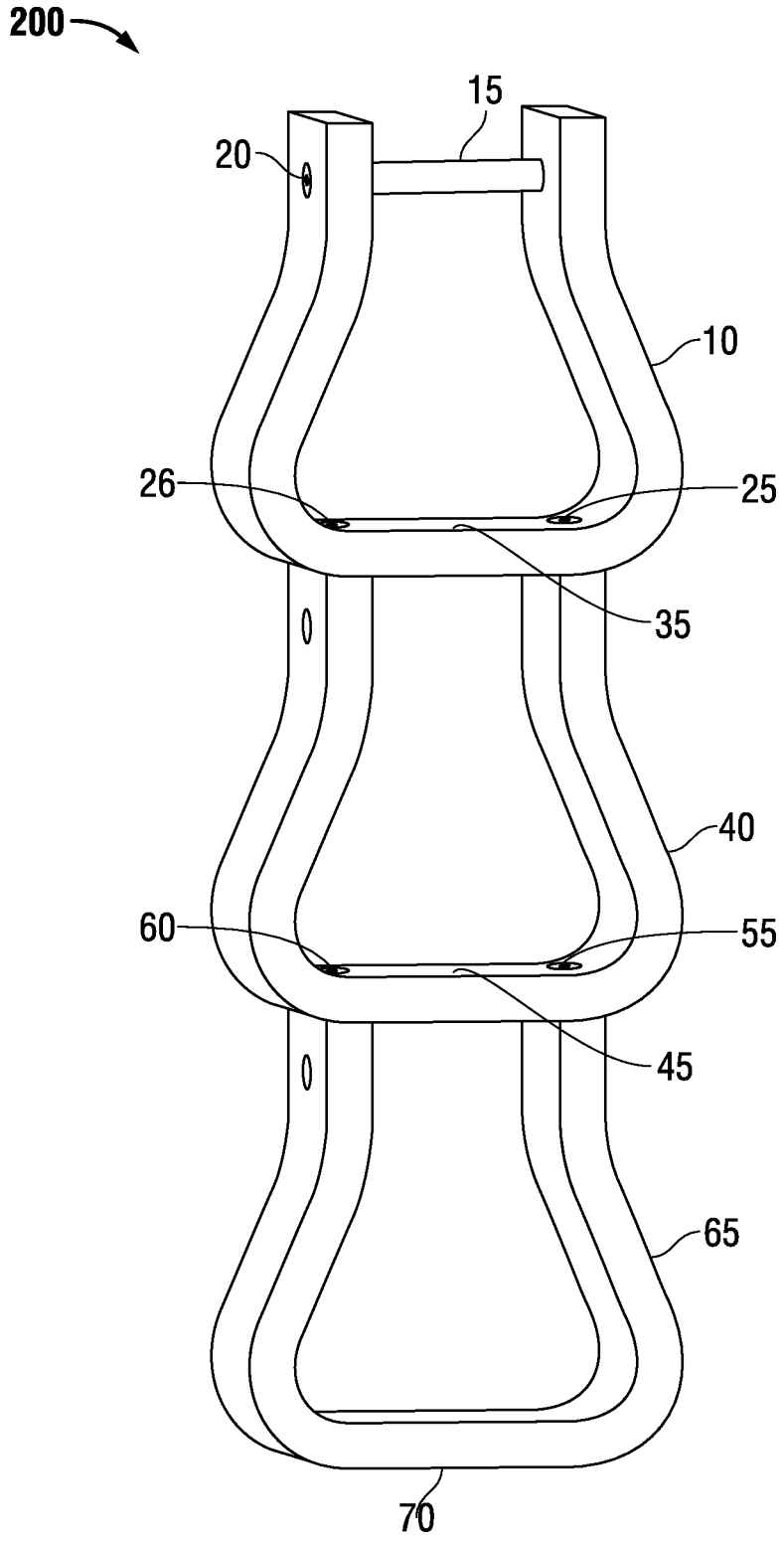
FIG. 3 is one embodiment of the invention in assembled perspective view with three stirrups.

FIG. 3 is one embodiment of the invention in assembled perspective view with three stirrups. The stirrup apparatus 200 may be constructed with three modified U-shaped rungs 10, 40 and third rung 65. In several embodiments, rungs 10, 40 and 65 may be comprised of aluminum, metal, hardened plastic, or other materials capable of supporting the weight of an adult human when a foot, boot or shoe is placed upon either rung 10, 40 or 65. In several embodiments, rungs 10, 40, and 65 can be designed to have flat interior or exterior faces. In several embodiments, rungs 10, 40, and 65 can be designed to have rounded or other three-dimensional shape interior or exterior faces. In several embodiments, rungs 10, 40, and 65 can be identical in manufacture such that rungs 10, 40, and 65 could be interchanged or replaced if the rung is damaged or needs replacement. In some embodiments, rungs 10, 40, and 65 or parts of them, can be composed of bent laminated plywood sandwiched between two pieces of thin bent sheets of metal for strength.

In several embodiments, the upper open portion of the rung 10 can be mechanically connected with bar 15. In several embodiments, bar 15 can be comprised of aluminum, hard plastic, metal or other materials as known in the art for stirrups. In several embodiments, bar 15 can be straight, curved, or in any other three-dimensional shape. In several embodiments, bar 15 is mechanically held between the open ends of rung 10 via a screw or nail 20 as is known in the art by the screw or nail 20 passing through an orifice on the upper open portion of rung 10. In several embodiments, bar 15 can be hollow and supported by a thru screw, or having it go through the sides of the U-shaped part for more support with washers and screws on either side.

In several embodiments, rung 10 can be attached to lower rung 40 via screws or nails 30 and 25 which can pass through orifices on lower portion 35 of rung 10 in a manner known in the art. Further shown is lower portion 45 on lower rung 40. As shown, screws or nails 60 and 55 can pass through the orifices at the bottom of rung flat portion 45 and attach third rung 65 to lower rung 40. In several embodiments, additional rungs 40 can be attached to rungs 65 as needed in series, in the manner disclosed.

Figure 4:
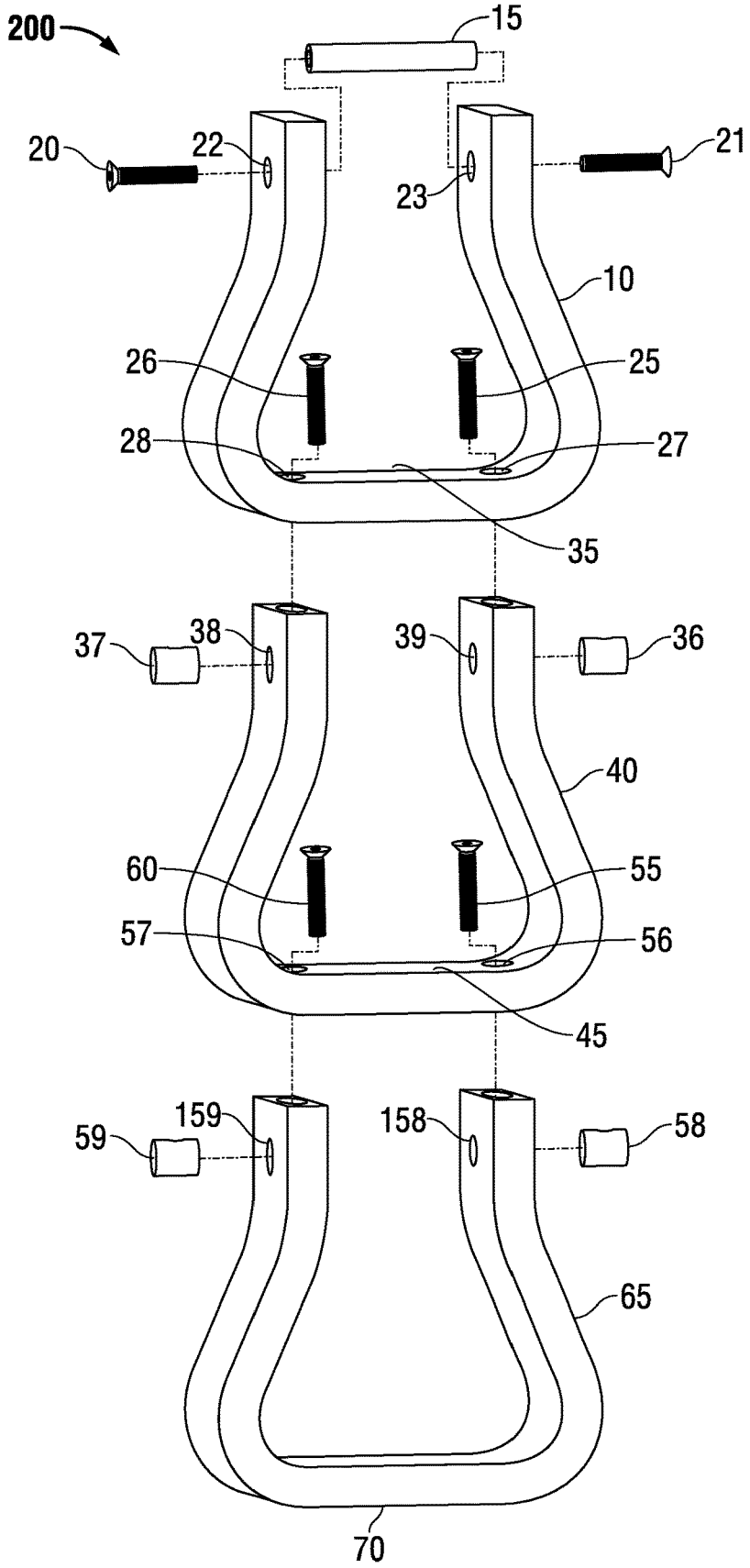
FIG. 4 is one embodiment of the invention in exploded perspective view with three stirrups.

FIG. 4 is one embodiment of the invention in exploded perspective view with three stirrups. As shown, stirrup apparatus 200 may be constructed with three modified U-shaped rungs 10, 40, and 65. In several embodiments, rungs 10, 40 and 65 may be comprised of aluminum, metal, hard plastic, or other materials capable of supporting the weight of an adult human when a foot is placed upon either rung 10, 40, or 65. In several embodiments, rungs 10, 40, or 65 can be designed to have flat interior or exterior faces. In several embodiments, rungs 10, 40, or 65 can be designed to have rounded or other three-dimensional shape interior or exterior faces. In several embodiments, rungs 10, 40, or 65 can be identical in manufacture such that rungs 10, 40, or 65 could be interchanged or replaced if the rung is damaged or needs replacement.

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via screws or nails 20 and 21 as is known in the art by the screw or nails 20 and 21 passing through an orifice on the upper open portion of rung 10 and screwing into bar 15. As further illustrated, screws or nails 20 and 21 can pass through orifices 22 and 23, respectively.

In several embodiments, rung 10 can be attached to lower rung 40 via screws or nails 25 and 26 which can pass through orifice 27 and 28 on lower portion 35 of rung 10 in a manner known in the art. Further shown are dowel nuts 37 and 36 which can be inserted into orifices 38 and 39, respectively, in order to secure screws or nails 26 and 25, respectively, as is known in the art. Further shown is lower portion 45 on lower rung 40.

In several embodiments, rung 65 can be attached to lower rung 40 via screws or nails 60 and 55 which can pass through orifices 57 and 56 on lower portion 45 of rung 40 in a manner known in the art. Further shown are dowel nuts 59 and 58 which can be inserted into orifices 159 and 158, respectively, in order to secure screws or nails 60 and 55, respectively, as is known in the art. Further shown is lower portion 70 on lower rung 65.

Figure 5:
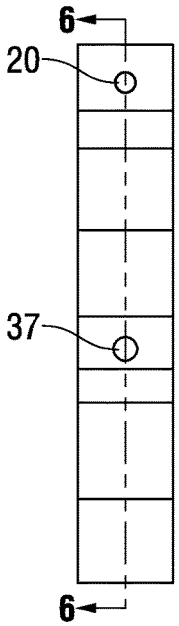
FIG. 5 is one embodiment of the invention in assembled side view with two stirrups.

FIG. 5 is one embodiment of the invention in assembled side view with two stirrups. As shown, screws or nails 20 and dowel nut 37 are present.

Figure 6:
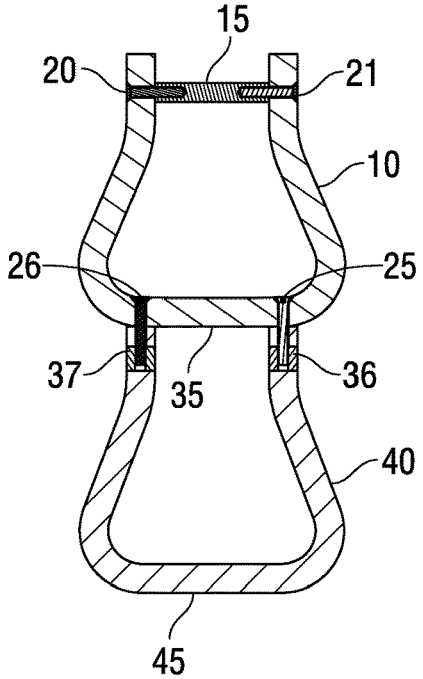
FIG. 6 is one embodiment of the invention in assembled front section view with two stirrups.

FIG. 6 is one embodiment of the invention in assembled front view with two stirrups. As shown in cross section, in several embodiments rung 10 can be attached to lower rung 40 via screws or nails 25 and 26 which can pass through orifices 27 and 28 (See FIG. 2) on lower portion 35 of rung 10 in a manner known in the art. Further shown are dowel nuts 37 and 36 which can be inserted into orifices 38 and 39 (See FIG. 2), respectively, in order to secure screws or nails 26 and 25, respectively, as is known in the art. Further shown is lower portion 45 on lower rung 40. In some embodiments of the present invention, the rungs and dowels can be precast together in one unit.

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via screws or nails 20 and 21 as is known in the art by the screws or nails 20 and 21 passing through orifices on the upper open portion of rung 10 and into bar 15.

Figure 7:
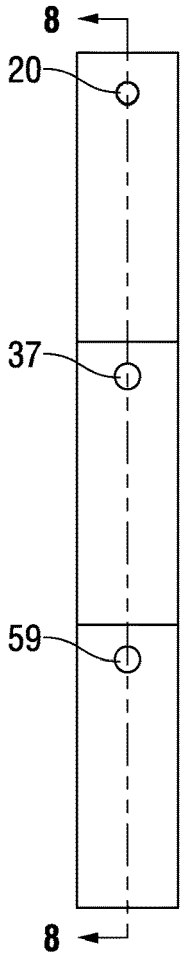
FIG. 7 is one embodiment of the invention in assembled side view with three stirrups.

FIG. 7 is one embodiment of the invention in assembled side view with three stirrups. As shown, screw or nail 20 and dowel nut 37 is present. Further shown is dowel nut 59 which can be inserted into orifice through 159 (See FIG. 4) in order to secure screw or nail 60 (See FIG. 4) as is known in the art.

Figure 8:
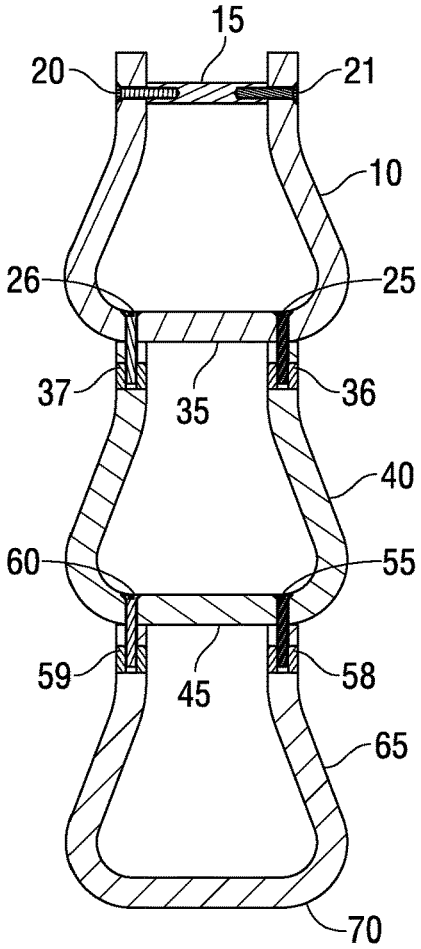
FIG. 8 is one embodiment of the invention in assembled front section view with three stirrups.

FIG. 8 is one embodiment of the invention in assembled front view with three stirrups. As shown in cross section, in several embodiments rung 10 can be attached to lower rung 40 via screws or nails 25 and 26 which can pass through orifices or holes 27 and 28 (See FIG. 2) on lower portion 35 of rung 10 in a manner known in the art. Further shown are dowel nuts 37 and 36 which can be inserted into orifices 38 and 39, respectively, in order to secure screws or nails 26 and 25, respectively, as is known in the art. Further shown is lower portion 45 on lower rung 40. In several embodiments, snaps, or leather thong attachments can be used in place of screw or nails 26 and 25.

In some embodiments, if the lower rung 40 is metal, the screws can screw directly into it without dowel nuts. If lower rung 40 is softer than metal, there needs to be some metal nut to clinch the screw tightly onto the stirrup.

In several embodiments, the upper open portion of the rung 10 can be mechanically connected with bar 15. In several embodiments, bar 15 can be comprised of aluminum, hard plastic, metal or other materials as known in the art for stirrups. In several embodiments, bar 15 can be straight, curved, or in any other three-dimensional shape. In several embodiments, bar 15 is mechanically held between the open ends of rung 10 via a screws or nails 20 and 21 as is known in the art by the screws or nails 20 and 21 passing through an orifice through or hole through on the upper open portion of rung 10.

In several embodiments, rung 65 can be attached to lower rung 40 via screws or nails 60 and 55 which can pass through orifice or hole 57 and 56 (See FIG. 4) on lower portion 45 of rung 40 in a manner known in the art. Further shown are dowel nuts 59 and 58 which can be inserted into orifices or holes 159 and 158 (See FIG. 4), respectively, in order to secure screws or nails 60 and 55, respectively, as is known in the art. Further shown is lower portion 70 on lower rung 65.

Figure 9:
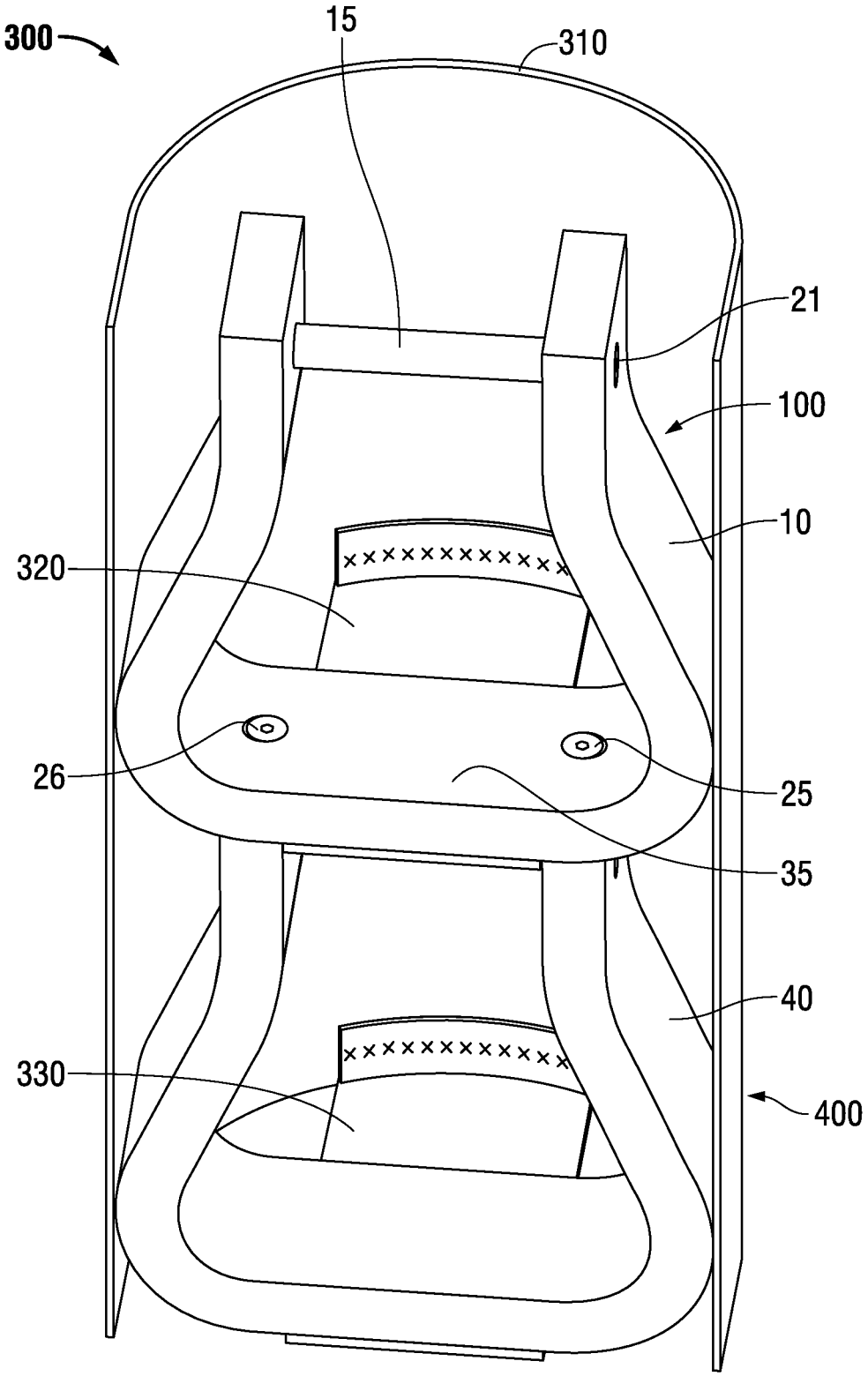
FIG. 9 is one embodiment of the invention in assembled perspective view with two stirrups with a tapadero cover.

FIG. 9 is one embodiment of the invention in assembled perspective view with two stirrups with a tapadero cover. As shown, is one embodiment of the tapadero assembly of the present invention 300. As illustrated, there is a tapadero cover 310 which can be designed out of any material as known in the art. Tapadero cover 310 can be of numerous geometric shapes. In several embodiments, inside the tapadero cover 310 are two shelves 320 and 330, respectively, which are attached to the tapadero cover 310. Shelves 320 and 330 are preferably designed to prevent a boot, shoe, or foot from slipping through the stirrup. In several embodiments, shelves 320 and 330 can be composed of wood, metal, hard plastic, or other materials capable of preventing a boot, shoe, or foot from slipping through stirrups 10 and/or 40, respectively. In many embodiments, shelves 320 and 330 can be of variant geometric shapes. In several embodiments, additional rungs 40 can be attached to rungs 65 as needed in series, in the manner disclosed. In several embodiments of the present invention the tapadero cover 310 is pre-molded and constructed with shelves 320 and 330 already molded into the tapadero cover 310. In several embodiments the tapadero cover 310 can be comprised of stiff leather, pliable thick leather, or leather pliable enough to poke holes through in order to insert screws or binding materials. In several embodiments, additional rungs 40 can be attached to rungs 65 as needed in series, in the manner disclosed. In several embodiments of the present invention the tapadero cover 310 is pre-molded and constructed with shelves 320 and 330 already molded into the tapadero cover 310.

Figure 10:
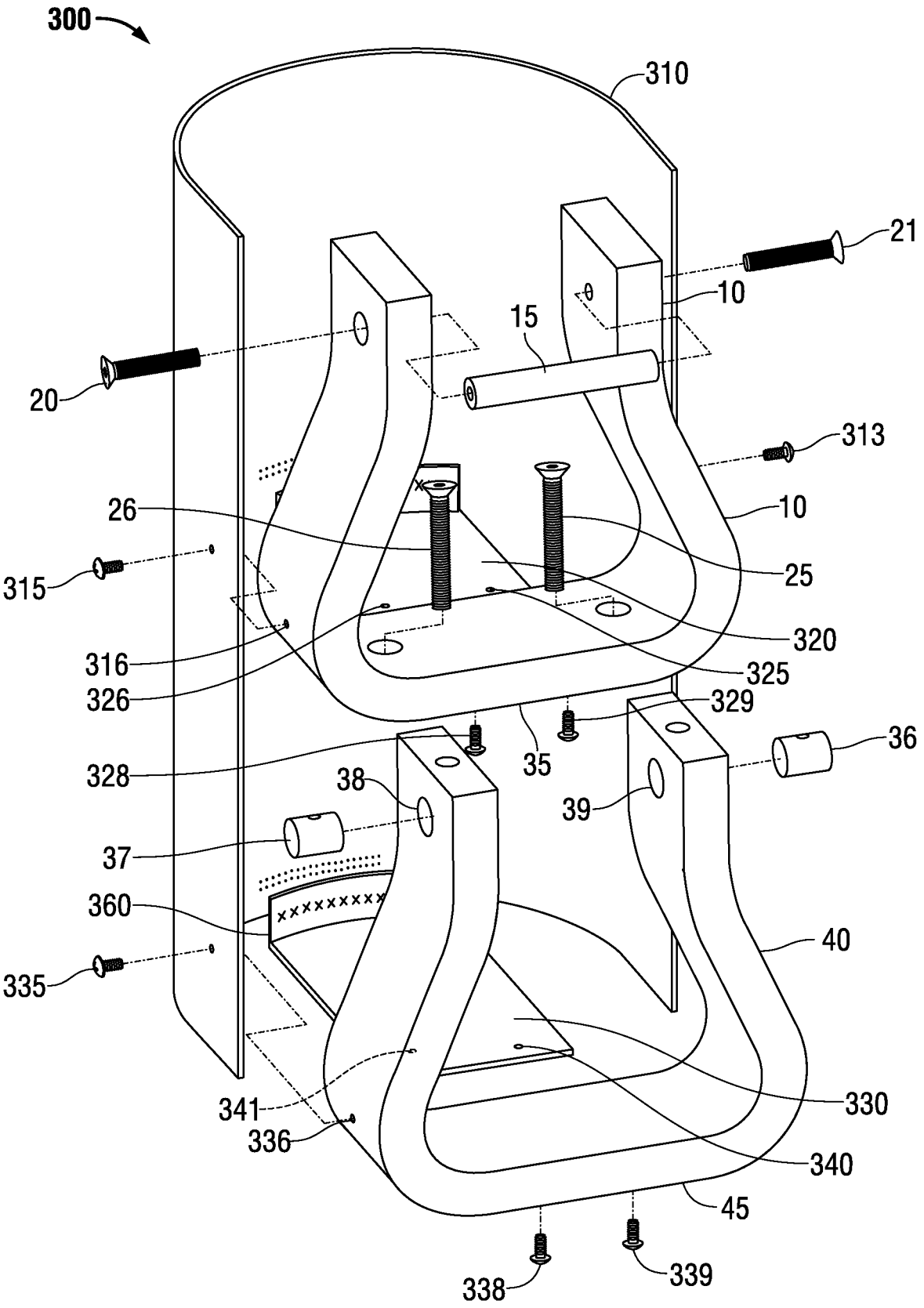
FIG. 10 is one embodiment of the invention in exploded perspective view with two stirrups with a tapadero cover.

FIG. 10 is one embodiment of the invention in exploded perspective view with two stirrups with a tapadero cover. As shown, is one embodiment of the tapadero assembly of the present invention 300. As illustrated, there is a tapadero cover 310 which can be designed out of any material as known in the art. Inside the tapadero cover 310 are two shelves 320 and 330, respectively, which are attached to the tapadero cover 310. Shelves 320 and 330 are preferably designed to prevent a foot, shoe, or boot from slipping through the stirrup and getting caught. In several embodiments, shelf 320 has screw orifice 326 and 325 to be used and has screws 328 and 329 attach the shelf 120 to the bottom of rung 10 in a manner known in the art. In several embodiments, shelf 330 has screw orifice 341 and 340 to be used and has screws 338 and 339 attach the shelf 340 to the bottom of rung 40 in a manner known in the art. In some embodiments the shelf 320 or 340 is part of the tapadero 310.

In several embodiments, rungs 10 and 40 may be comprised of aluminum, metal, hard plastic, or other materials capable of supporting the weight of an adult human when a foot is placed upon either rung 10 or 40. In several embodiments, rungs 10 and 40 can be designed to have flat interior or exterior faces. In several embodiments, rungs 10 and 40 can be designed to have rounded or other three-dimensional shape interior or exterior faces. In several embodiments, rungs 10 and 40 can be identical in manufacture such that rungs 10 and 40 could be interchanged or replaced if the rung is damaged or needs replacement.

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via a screws or nails 20 and 21 as is known in the art by the screws or nails 20 and 21 passing through orifice or hole 22 and 23 (See FIG. 2) on the upper open portion of rung 10. As further illustrated, screws or nails 20 and 21 can pass through orifice or hole 22 and 23 (See FIG. 2), respectively.

In several embodiments, rung 10 can be attached to lower rung 40 via screws or nails 25 and 26 which can pass through orifice or hole 27 and 28 (See FIG. 2) on lower portion 35 of rung 10 in a manner known in the art. Further shown are dowel nuts 37 and 36 which can be inserted into orifice or hole 38 and 39, respectively, in order to secure screws or nails 26 and 25, respectively, as is known in the art. Further shown is lower portion 45 on lower rung 40.

Figure 12:
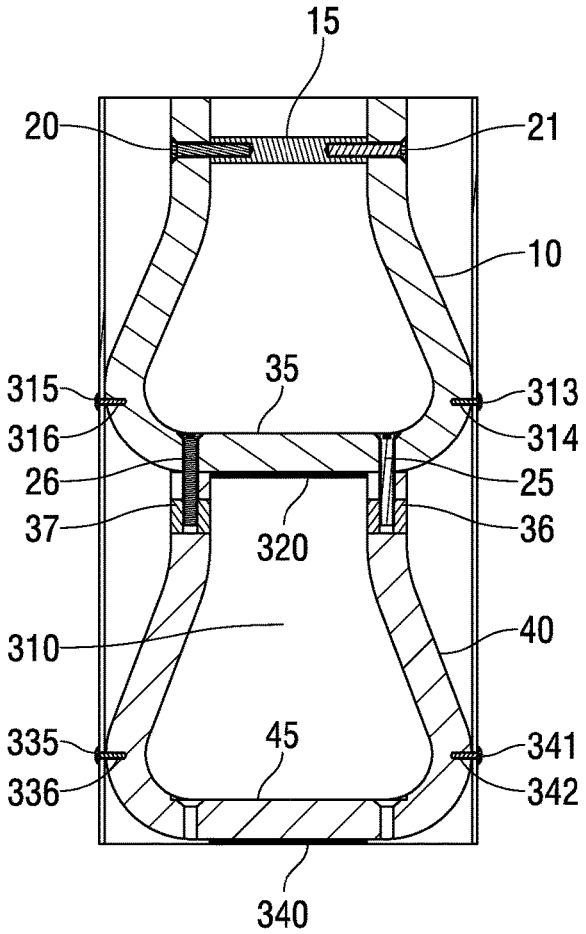
FIG. 12 is one embodiment of the invention in assembled back section view with two stirrups and a tapadero cover.

As further illustrated, in some embodiments of the present invention, rung 10 is modified to have screw orifices or holes 316 and 314 (FIG. 12). Tapadero cover 310 is modified to have screw holes and screws 315 and 313 (FIG. 12). As further illustrated, in some embodiments of the present invention, rung 40 is modified to have screw through orifice or hole 336 and 342 (FIG. 12). Tapadero cover 310 is modified to have screw holes and screws 335 and 341 (FIG. 12). Further illustrated in FIG. 10 is leather lace strap 360, which in some embodiments can further attach shelf 330 to tapadero 310.

In some embodiments, the shelf and leather lace strap 360 is one piece made of soft leather. The laces are made of strong leatherworking cord going from the strap 360 through a tapadero 310 and back again multiple times to form a strong connection between the strap 360, leather shelf and exterior tapadero 310.

Figure 11:
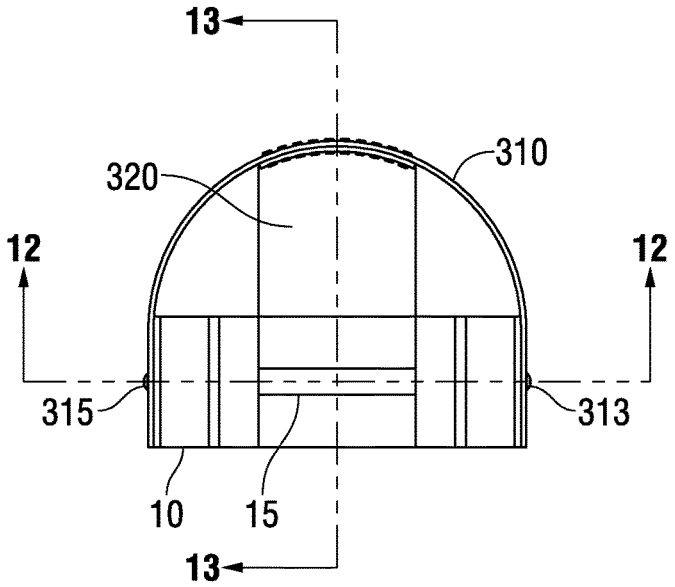
FIG. 11 is one embodiment of the invention in assembled top view with two stirrups and a tapadero cover.

FIG. 11 is one embodiment of the invention in assembled top view with two stirrups and a tapadero cover. As illustrated, there is a tapadero cover 310 which can be designed out of any material as known in the art. Inside the tapadero cover 310 are two shelves 320 and 330 (See FIG. 10), respectively, which are attached to the tapadero cover 310. Shelves 320 and 330 (See FIG. 10) are preferably designed to prevent a foot, shoe, or boot from slipping through the stirrup and getting caught. In several embodiments, shelf 320 has screw through orifice or hole 326 and 325 to be used and have screw 328 and 329 to attach the shelves to the bottom of rung 10 in a manner known in the art. In several embodiments, shelf 330 has screw through orifice or hole 341 and 340 to be used and has screws 338 and 339 attach the shelf 320 to the bottom of rung 40 in a manner known in the art (See FIG. 10).

In several embodiments, the upper open portion of the rung 10 can be mechanically connected with bar 15. In several embodiments, bar 15 can be comprised of aluminum, hard plastic, metal, or other materials as known in the art for stirrups. In several embodiments, bar 15 can be straight, curved, or in any other three-dimensional shape. In several embodiments, bar 15 is mechanically held between the open ends of rung 10 via screws or nails 20 and 21 as is known in the art by the screws or nails 20 and 21 passing through an orifice on the upper open portion of rung 10. Further shown, tapadero cover 310 is modified to have screw holes and screws 315 and 313.

FIG. 12 is one embodiment of the invention in assembled back section view with two stirrups and a tapadero cover. In several embodiments, the upper open portion of the rung 10 can be mechanically connected with bar 15. In several embodiments, bar 15 can be comprised of aluminum, hard plastic, metal or other materials as known in the art for stirrups. In several embodiments, bar 15 can be straight, curved, or in any other three-dimensional shape. In several embodiments, bar 15 is mechanically held between the open ends of rung 10 via screws or nails 20 and 21 as in known in the art by the screws or nails 20 and 21 passing through an orifice or hole on the upper open portion of rung 10 then screwing or pressing into bar 15.

As further illustrated in some embodiments of the present invention, rung 10 is modified to have screw through orifices 316 and 314. Tapadero cover 310 is modified to have screw holes and screws 315 and 313. As further illustrated in some embodiments of the present invention, rung 40 is modified to have screw orifices 336 and 342. Tapadero cover 310 is modified to have screw holes and screws 335 and 341.

In several embodiments, rung 10 can be attached to lower rung 40 via screws or nails 25 and 26 which can pass through orifices 27 and 28 (See FIG. 4) on lower portion 35 of rung 10 in a manner known in the art. Further shown are dowel nuts 37 and 36 which can be inserted into orifice or hole 38 and 39 (See FIG. 4), respectively, in order to secure screws or nails 26 and 25 (See FIG. 4), respectively, as is known in the art. Further shown is lower portion 45 on lower rung 40.

Figure 13:
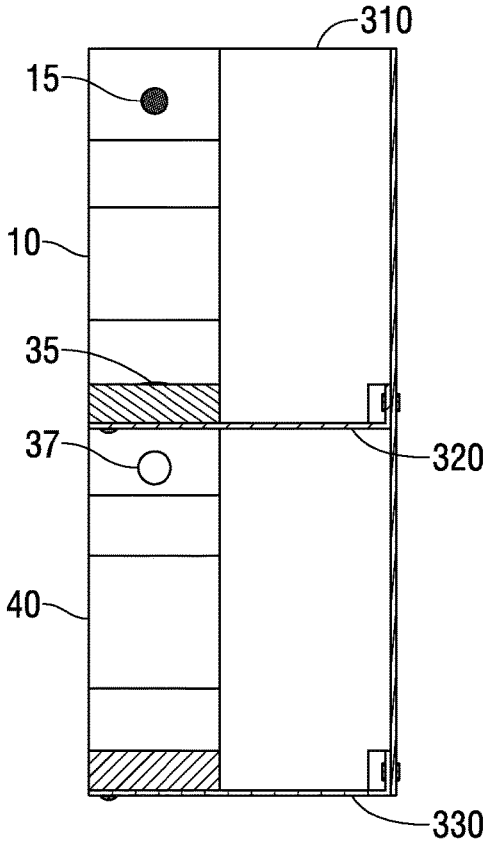
FIG. 13 is one embodiment of the invention in assembled side section view with two stirrups and a tapadero cover.

FIG. 13 is one embodiment of the invention in assembled section side view with two stirrups and a tapadero cover. In several embodiments, rung 10 can be attached to lower rung 40 via screws or nails 26 and 25 (See FIG. 4) which can pass through orifice or hole on lower portion 35 of rung 10 in a manner known in the art. Further shown is lower portion 45 on lower rung 40. As illustrated, there is a tapadero cover 310 which can be designed out of any material as known in the art. Inside the tapadero cover 310 are two shelves 320 and 330, respectively, which are attached to the tapadero cover 310. Shelves 320 and 330 are preferably designed to prevent a foot, shoe, or boot from slipping through the stirrup and getting caught.

In several embodiments, bar 15 is mechanically held between the open ends of rung 10 via a screws or nails 20 as is known in the art by the screws or nails 20 passing through the orifices on the upper open portion of rung 10 and into or through bar 15. In several embodiments, rungs 10 and 40 may be comprised of aluminum, metal, hard plastic, or other materials capable of supporting the weight of an adult human when a foot is placed upon either rung 10 or 40. In several embodiments, rungs 10 and 40 can be designed to have flat interior or exterior faces. In several embodiments, rungs 10 and 40 can be designed to have rounded or other three-dimensional shape interior or exterior faces. In several embodiments, rungs 10 and 40 can be identical in manufacture such that rungs 10 and 40 could be interchanged or replaced if the rung is damaged or needs replacement.

In several embodiments, a user can place their foot into rung 10, 40, or 65 when mounting a horse, or other animal, or when riding a horse or other animal. It should also be noted that additional rungs apart from 10, 40, and/or 65 can be utilized with the present invention to make a series of rungs that can range from two rungs to any number of rungs attached in sequence.

In several embodiments of the present invention, one method of getting into the rungs 10 and 40 is as follows: the upper rungs 10 are adjusted for a user's height and if the user is getting up on the left side of the horse: 1) the user puts their left foot in the lower left rung 40 and lifts them-self up onto the saddle using their left leg and two hands and putting their right leg on the other side of saddle 2) once in the saddle user moves their left foot from the lower left 40 and puts it into the upper left rung 10, and 3) user pushes with the left leg and slides to the right until they are centered in the saddle, user then puts their right foot into the upper right stirrup 10.

In several embodiments, if the upper rungs 10 are adjusted for a user's height and if a user is getting up on the left side of the horse: 1) user puts their right foot into the lower left rung 40 and lifts themselves up with their right foot and two hands on the saddle, 2) user then puts their left foot into the upper left stirrup 10 then removes their right foot from the lower left rung 40 and swings their right leg over the saddle so that they are sitting centered in the saddle, and 3) user then puts their right foot into the upper right stirrup 10.

While preferred embodiments have been shown, and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied.

What is claimed is the following:

1. An improved stirrup comprising:
a first open-ended rung;
said first rung further comprising;
an open-ended top portion with an orifice on each open-ended rung side and a solid bottom rung portion with two orifices running through the bottom portion;
a second open ended rung;
said second rung further comprising;
an open ended second top portion with an orifice on each open-ended rung side, two orifices, each on the corresponding upward faces of each open-ended rung side, and a solid second bottom rung portion;
a hollow or internally threaded bar;
a first set of screws;
a second set of screws;
a screw fastening bar set;
wherein said hollow or internally threaded bar is mechanically attached between said open-ended top portion of said first open-ended rung by said first set of screws being inserted through said open ended top portion orifices and inserted or threaded into said hollow or internally threaded bar; and
wherein said screw fastening bar set is inserted into said orifices on said open-ended rung sides of said second rung, and said second rung is mechanically attached to said first rung by having said second set of screws inserted through said two orifices on said bottom rung portion of said first rung and into said two orifices on the upward faces of each open-ended rung side of said second rung and threaded into or fastened to said screw fastening bar set.

2. The improved stirrup of claim 1 further comprising;
said first rung and said hollow or threaded bar are precast as one piece.

3. The improved stirrup of claim 1 further comprising;
a tapadero;
said tapadero further comprising;
a front barrier attached to a first shelf and a second shelf; and
said first rung bottom is attached to the said first shelf and said second rung bottom is attached to the said second shelf.

4. The improved stirrup of claim 3 further comprising;
said tapadero is comprised of one piece of material.

5. An improved stirrup comprising:
a first open-ended rung;
said first rung further comprising;
an open-ended top portion with an orifice on each open-ended rung side and a solid bottom rung portion with two orifices running through the bottom portion;
a second open-ended rung;
said second rung further comprising;
an open-ended second top portion with an orifice on each open-ended rung side, two orifices each on the corresponding upward faces of each open-ended rung side, and a solid second bottom rung portion with two orifices running through the bottom portion;

a third open-ended rung;

said third rung further comprising;

an open-ended third top portion with an orifice on each open-ended rung side, two orifices, each on the corresponding upward faces of each open-ended rung side, and a solid third bottom rung portion;

a hollow or internally threaded bar;

a first set of screws;

a second set of screws;

a third set of screws;

a screw fastening bar set;

a second screw fastening bar set;

wherein said hollow or internally threaded bar is mechanically attached between said open-ended top portion of said first open-ended rung by said first set of screws being threaded or inserted through said open-ended top portion orifices and threaded or inserted into said hollow or threaded bar;

wherein said screw fastening bar set is inserted into said orifices or holes on said open-ended rung sides of said second rung, and said second rung is mechanically attached to said first rung by having said second set of screws inserted into said two orifices on said bottom rung portion of said first rung and into said two orifices on the upward faces of each open-ended rung side of said second rung then threaded into or fastened to screw fastening bar set; and wherein said second screw fastening bar set is inserted into said orifices on said open-ended rung sides of third rung, and said third rung is mechanically attached to said second rung by having said third set of screws inserted into said orifices on said bottom rung portion of said second rung and into said two orifices on the upward faces of each open-ended rung side of said third rung then threaded into or fastened to screw fastening bar set.

6. The improved stirrup of claim 5 further comprising;

said first rung and said hollow or threaded bar are precast as one piece.

7. The improved stirrup of claim 5 further comprising;

a tapadero;

said tapadero further comprising;

a front barrier attached to a first shelf, a second shelf and a third shelf; and said first rung bottom is attached to the said first shelf, said second rung bottom is attached to the said second shelf, and said third rung bottom is attached to the said third shelf.

8. The improved stirrup of claim 7 further comprising;

said tapadero is comprised of one piece of material.

9. An improved stirrup comprising:

a multitude of open-ended rungs;

each individual rung of said multitude of rungs further comprising;

an open-ended top portion with an orifice on each open-ended rung side and a solid bottom rung portion with two orifices running through the bottom portion;

a single hollow or internally threaded bar;

a multitude of sets of screws;

a multitude of screw fastening bar sets;

wherein one said hollow or internally threaded bar is mechanically attached between said open ended top portion of a first open-ended rung by at least one individual member of said set of screws being threaded or inserted through said open-ended top portion orifice through and into said hollow or threaded bar;

wherein at least one member of said screw fastening bar sets is inserted into said orifice on said open-ended rung sides of a second said rung, and said second rung is mechanically attached to said first rung by having said second set of screws inserted through said two orifices on said bottom rung portion of said first rung and into two orifices each on the corresponding on the upward faces of each open-ended rung side of said second rung and threaded or fastened to said at least one screw fastening bar set in a series of rung attachments.

10. The improved stirrup of claim 9 further comprising;

said multitude rung and said first hollow or threaded bar is precast as a multitude of one single piece.

11. The improved stirrup of claim 9 further comprising;

a tapadero;

said tapadero further comprising;

a front barrier attached to a first shelf, a second shelf and a third shelf; and said first rung bottom is attached to the said first shelf, said second rung bottom is attached to the said second shelf, and a third ring bottom is attached to the said third shelf.

12. The improved stirrup of claim 11 further comprising;

said tapadero is comprised of one piece of material.

* * * * *